US012156604B2

(12) United States Patent
Lee

(10) Patent No.: US 12,156,604 B2
(45) Date of Patent: Dec. 3, 2024

(54) PORTABLE MAT CAPABLE OF BLOCKING AIR CONVECTION AND TEMPERATURE RADIATION

(71) Applicant: CATHAY CONSOLIDATED INC., Yilan County (TW)

(72) Inventor: Hao-Chen Lee, Yilan County (TW)

(73) Assignee: CATHAY CONSOLIDATED INC., Yilan County (TW)

( * ) Notice: Subject to any disclaimer, the term of this patent is extended or adjusted under 35 U.S.C. 154(b) by 37 days.

(21) Appl. No.: 17/830,308

(22) Filed: Jun. 1, 2022

(65) Prior Publication Data

US 2023/0389729 A1 Dec. 7, 2023

(51) Int. Cl.

| | |
|---|---|
| ***A47G 9/06*** | (2006.01) |
| ***A45F 3/00*** | (2006.01) |
| ***A47C 27/08*** | (2006.01) |
| ***A47C 27/12*** | (2006.01) |
| ***A47C 27/16*** | (2006.01) |

(52) U.S. Cl.

CPC ..... *A47G 9/06* (2013.01); *A45F 3/00* (2013.01); *A47C 27/12* (2013.01); *A47C 27/087* (2013.01); *A47C 27/127* (2013.01); *A47C 27/16* (2013.01)

(58) Field of Classification Search

CPC ..... A47C 27/12; A47C 27/08; A47C 27/081; A47C 27/082; A47C 27/083; A47C 27/084; A47C 27/087; A47C 27/088; A47C 27/10; A47C 27/127; A47C 27/128; A47C 27/142; A47C 27/144; A47C 27/15; A47C 27/16; A47C 27/18; A45F 3/00; A47G 9/06; Y10T 428/24744

See application file for complete search history.

(56) References Cited

U.S. PATENT DOCUMENTS

| | | | | |
|---|---|---|---|---|
| 4,399,575 | A * | 8/1983 | Hall | A47C 27/085 5/684 |
| 2007/0044243 | A1* | 3/2007 | Metzger | A47C 27/087 5/710 |
| 2009/0320211 | A1* | 12/2009 | Lau | A47C 27/087 5/713 |
| 2012/0000017 | A1* | 1/2012 | Xia | A47C 27/087 5/706 |
| 2021/0169231 | A1* | 6/2021 | Huang | A47C 27/087 |

* cited by examiner

*Primary Examiner* — David R Hare
*Assistant Examiner* — Deborah Talitha Gedeon
(74) *Attorney, Agent, or Firm* — Chun-Ming Shih; HDLS IPR SERVICES

(57) ABSTRACT

A portable mat capable of blocking air convection and temperature radiation is disclosed. The portable mat is an inflatable mat, and includes a first outer covering layer and a second outer covering layer that are connected by a plurality of connecting members each in the form of a thin and light ring. Side pieces of the connecting members each have different widths according to high and low positions. A plurality of blocking layers of a blocking unit is fitted on the connecting members. The block layers have openings with different widths. The openings of the blocking layers are different in size corresponding to the different widths of the connecting member, so that the blocking layers are positioned at different heights to form a plurality of spaced space inside the mate, thereby blocking air convection and reducing temperature radiation.

10 Claims, 5 Drawing Sheets

PORTABLE MAT CAPABLE OF BLOCKING AIR CONVECTION AND TEMPERATURE RADIATION

FIELD OF THE INVENTION

The present invention relates to a portable mat, and more particularly to a portable mat capable of blocking air convection and temperature radiation.

BACKGROUND OF THE INVENTION

In recent years, more and more people love outdoor leisure activities, including camping and climbing. In addition to preparing enough food and drinking water, it is very important for keeping warm. If there are no enough equipages to keep out the cold, a person may suffer from hypothermia, which will cause trembling, unconsciousness, or mental disorder. However, if a person suffers from severe hypothermia, it will cause shock, cardiac arrest, and deadly danger. The so-called super marathon plays in the polar region for several days. This region is dozens of degrees below minus all year round. People may suffer from frostbite and hypothermia easily. Besides, rescue in deep mountains or the polar region is not easy. Participating or challenging polar sports requires complete, top-level equipages to reduce risks.

Regardless of general mountain activities or polar activities, people may suffer from hypothermia when sleeping at night because the temperature is lower at night. If a person lies directly on the ground, the low-temperature conduction of the ground will increase the chance of suffering from hypothermia. Thus, people often put a layer of aluminum foil pad under the sleeping mat to reduce the low-temperature conduction of the ground. However, the effect of keeping out the cold for this single-layer aluminum foil pad is not good. If it is used in polar climate, the effect of keeping out the cold is poor. Furthermore, outdoor activities, such as camping, need a lot of equipages. It is required for all equipages to be lightweight. Equipages need to meet the requirements of being light, easy storage and the like, which indirectly affect functional improvements. As to sleeping mats on the market, the effect of keeping out the cold is not good, or the sleeping mat is heavy. If this sleeping mat is used in the polar environment, it cannot meet the requirements. Accordingly, the inventor of the present invention has devoted himself based on his many years of practical experiences to solve these problems.

SUMMARY OF THE INVENTION

The primary object of the present invention is to provide a portable mat capable of blocking air convection and temperature radiation, which is an inflatable mat. Its structure is made of thin and light sheets, so it meets the basic needs of portability. Furthermore, a plurality of spaced spaces is formed in the mat, so that the mat can improve the functions of blocking air convection and reducing temperature radiation greatly.

Another object of the present invention is to provide a portable mat capable of blocking air convection and temperature radiation, which provides connecting members inside the mat. The side piece of the connecting member has different widths according to height and low positions. A plurality of blocking layers is fitted on the connecting members, having openings corresponding in position and in number to the connecting members. The openings of the blocking layers are different in size corresponding to the different widths of the connecting member, so that the blocking layers are positioned at different heights to form the plurality of spaced space inside the mate, thereby blocking air convection and reducing temperature radiation.

A further object of the present invention is to provide a portable mat capable of blocking air convection and temperature radiation, which can be manufactured easily. When the blocking layers are to be fitted on the connecting members, they will be automatically positioned through the openings of different sizes to correspond to the different widths of the side pieces of the connecting members. Therefore, it is only required to put the blocking layers on the connecting members in production, without complicated procedures, so as to save time in processing, improve efficiency, reduce production costs, lower selling prices and improve competitiveness.

In order to achieve the foregoing objects, a portable mat capable of blocking air convection and temperature radiation is provided. The mat is an inflatable structure. The mat comprises a first outer covering layer, a second outer covering layer, and a space defined between the first outer covering layer and the second outer covering layer. The peripheries of the first outer covering layer and the second outer covering layer are joined and closed. The first outer covering layer and the second outer covering layer are connected by a plurality of connecting members.

In an embodiment, the connecting member is in the form of a thin and light ring. The connecting member is formed by a single sheet or two sheets joined together. A first joining portion is disposed on a top of the connecting member. The first joining portion is joined to an inner edge of the first covering layer. A second joining portion is disposed on a bottom of the connecting member. The second joining portion 22 is joined to an inner edge of the second covering layer. The connecting member includes two corresponding side pieces. The side pieces each have different widths according to height and low positions. For example, the side pieces each have a trapezoid shape with a narrow upper portion and a wide lower portion or a regular hexagon shape with narrow upper and lower portions and a wide middle portion. Besides, the side pieces each have stepped sides, but not limited thereto.

In an embodiment, the mat further comprises a blocking unit fitted on the connecting members. The blocking unit includes one or more than two blocking layers. The blocking layers each have openings corresponding in position and in number to the connecting members. The openings of the blocking layers are fitted on the connecting members and correspond to the different widths of the side piece. The openings of the blocking layers are different in size, having different widths.

In an embodiment, the blocking layer of the blocking unit is made of a polyester film material with high reflectivity and low absorptivity. The application of materials is a well-known technology, and will not be described in detail.

In an embodiment, the mat is a seat mat or a sleeping mat, and the size of the mat can be changed as required.

In an embodiment, the inflatable mat is equipped with a nozzle, which can be inflated or deflated as required for portability. It is a known art.

DETAILED DESCRIPTION OF THE PREFERRED EMBODIMENTS

Embodiments of the present invention will now be described, by way of example only, with reference to the accompanying drawings.

Figure 1:
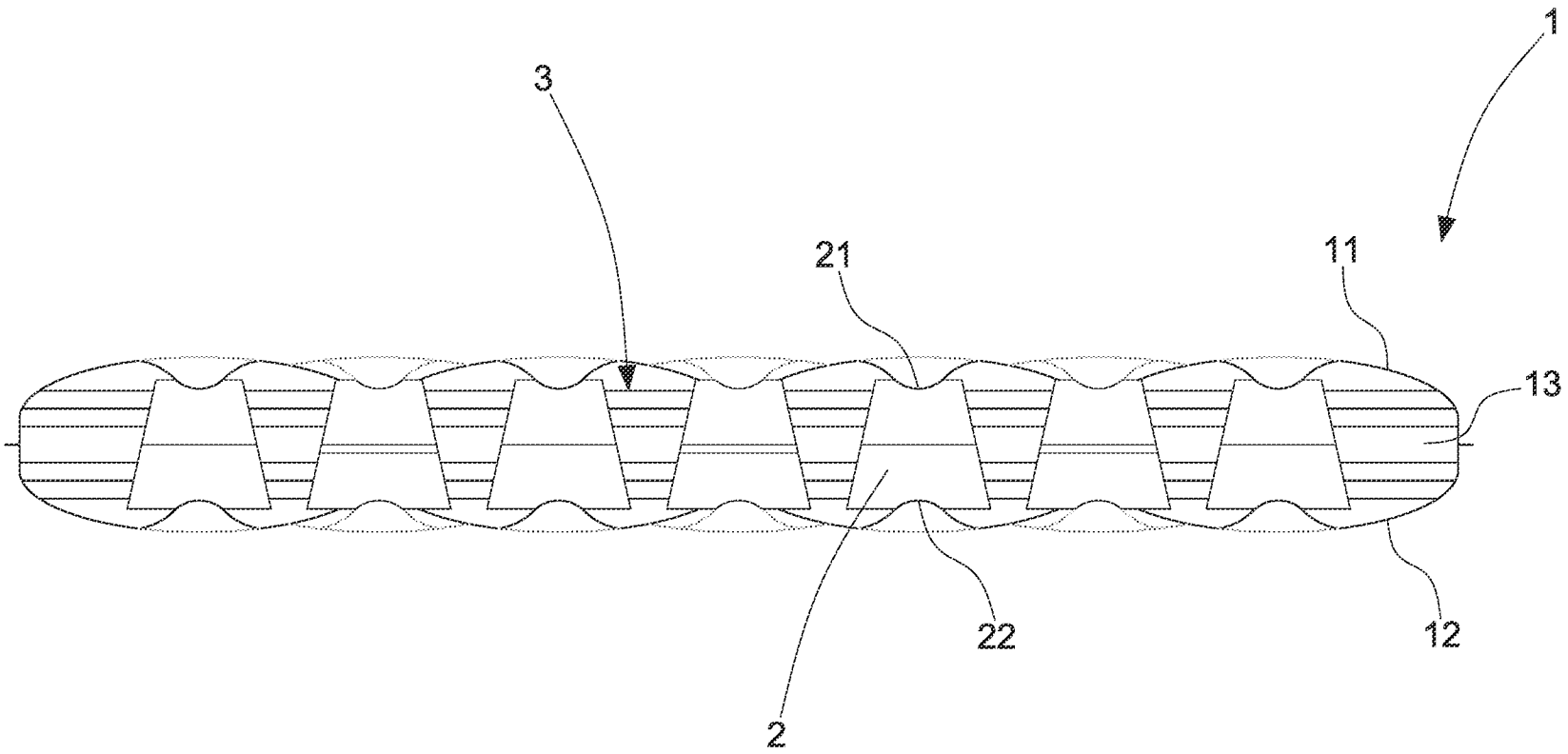
FIG. 1 is a cross-sectional view according to a first embodiment of the present invention.
Figure 2:
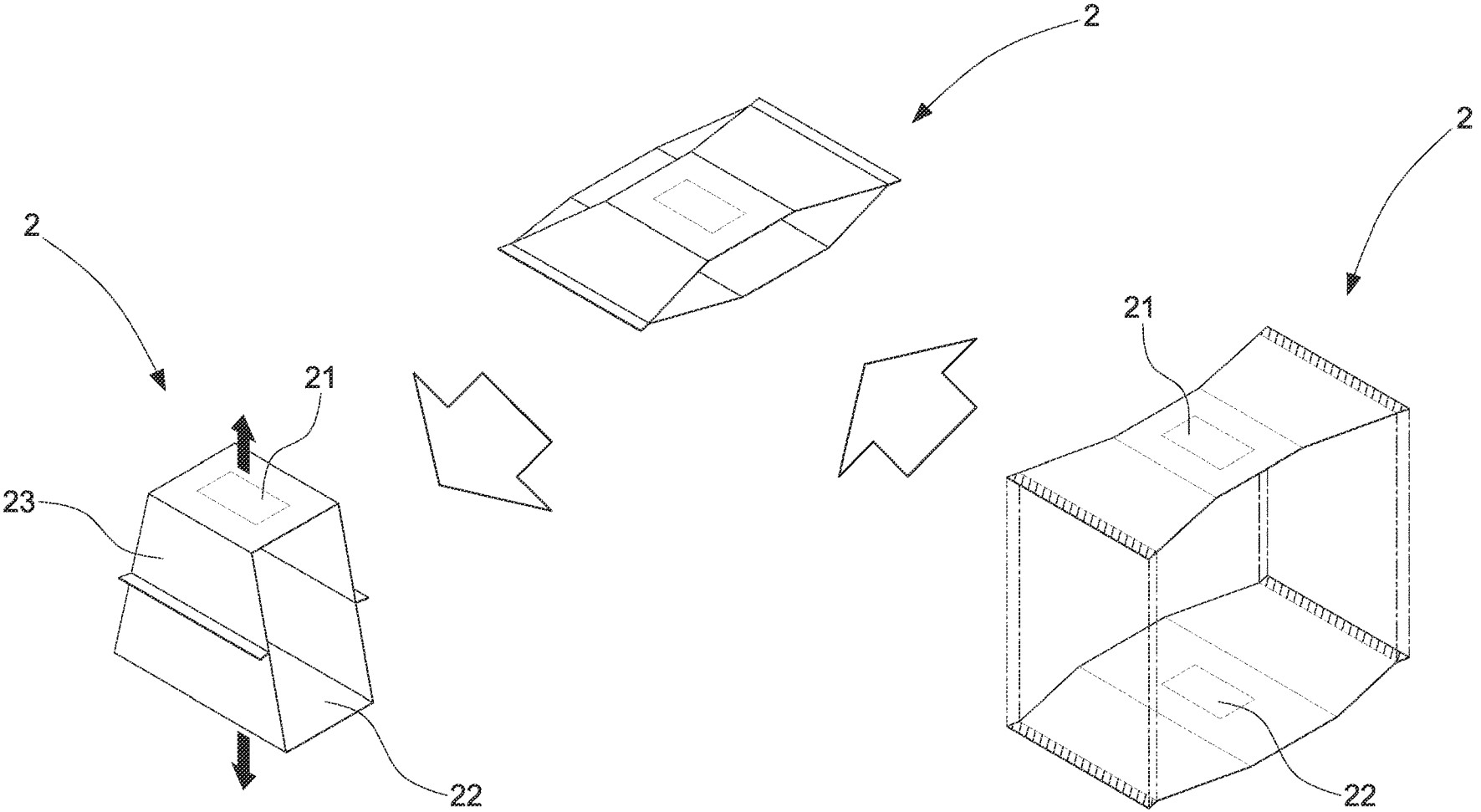
FIG. 2 is a schematic view of the connecting member according to the first embodiment of the present invention.
Figure 3:
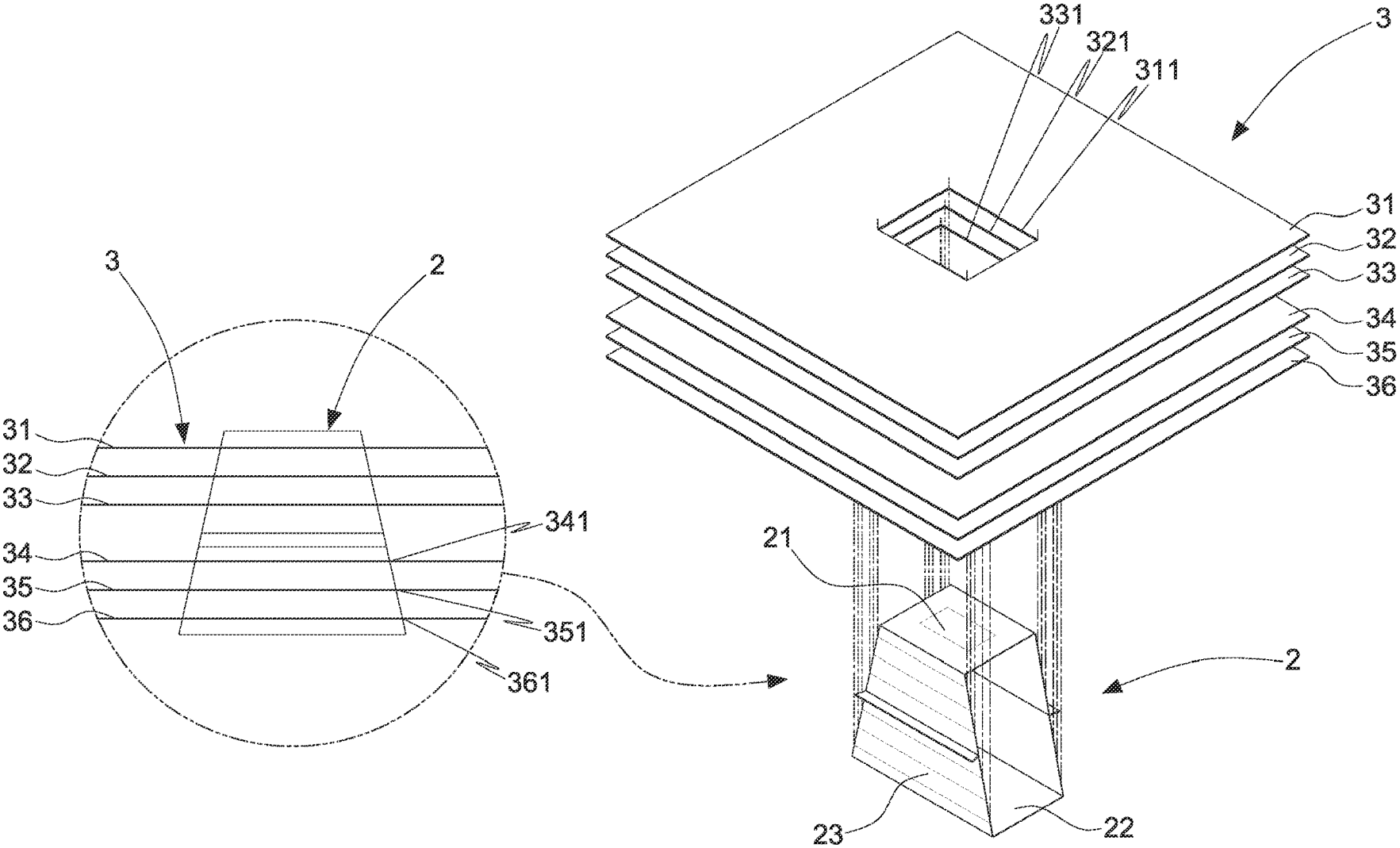
FIG. 3 is a schematic view of the blocking unit fitted and positioned on the connecting member according to the first embodiment of the present invention.

Please refer to FIG. 1, FIG. 2 and FIG. 3. The present invention discloses a portable mat 1 capable of blocking air convection and temperature radiation. The mat 1 is an inflatable structure. The mat 1 comprises a first outer covering layer 11, a second outer covering layer 12, and a space 13 defined between the first outer covering layer 11 and the second outer covering layer 12. The peripheries of the first outer covering layer 11 and the second outer covering layer 12 are joined and closed.

The first outer covering layer 11 and the second outer covering layer 12 are connected by a plurality of connecting members 2. The connecting member 2 is in the form of a thin and light ring. The connecting member 2 may consist of two sheets joined together, or it may be a single-sheet integrated structure. A first joining portion 21 is disposed on the top of the connecting member 2. The first joining portion 21 is joined to the inner edge of the first covering layer 11. A second joining portion 22 is disposed on the bottom of the connecting member 2. The second joining portion 22 is joined to the inner edge of the second covering layer 22. The connecting member 2 includes two corresponding side pieces 23. The side piece 23 is designed to have different widths according to height and low positions. In this embodiment, The side piece 23 has a trapezoid shape with a narrow upper portion and a wide lower portion.

The present invention further comprises a blocking unit 3 fitted on the connecting member 2. The blocking unit 3 is composed of one or more than two blocking layers. In this embodiment, the blocking unit 3 has six layers (the number of layers can be increased or decreased arbitrarily), including a first blocking layer 31, a second blocking layer 32, a third blocking layer 33, a fourth blocking layer 34, a fifth blocking layer 35, and a sixth blocking layer 36. A plurality of first openings 311 is defined in the first blocking layer 31. A plurality of second openings 321 is defined in the second blocking layer 32. A plurality of third openings 331 is defined in the third blocking layer 33. A plurality of fourth openings 341 is defined in the fourth blocking layer 34. A plurality of fifth openings 351 is defined in the fifth blocking layer 35. A plurality of sixth openings 361 is defined in the sixth blocking layer 36. The openings correspond in position to the connecting members 2. Because the side piece 23 of the connecting member 2 is designed to have different widths according to height and low positions, with a narrow upper portion and a wide lower portion, the widths of the first opening 311 to the sixth opening 361 gradually increase. As shown in FIG. 3, after the blocking layers 31, 32, 33, 34, 35, 36 are fitted on the connecting member 2, they are held and positioned by the corresponding widths of the side piece 23 according to high and lower positions, so that the blocking layers 31, 32, 33, 34, 35, 36 are spaced apart from each other to form a plurality of spaced spaces. Because the spaced spaces are not in communication with each other, they can be used to block air convection and temperature radiation. Thus, when the mat 1 is used in a polar environment, it can effectively resist the low temperature on the ground and prevent the user from suffering hypothermia.

Figure 4:
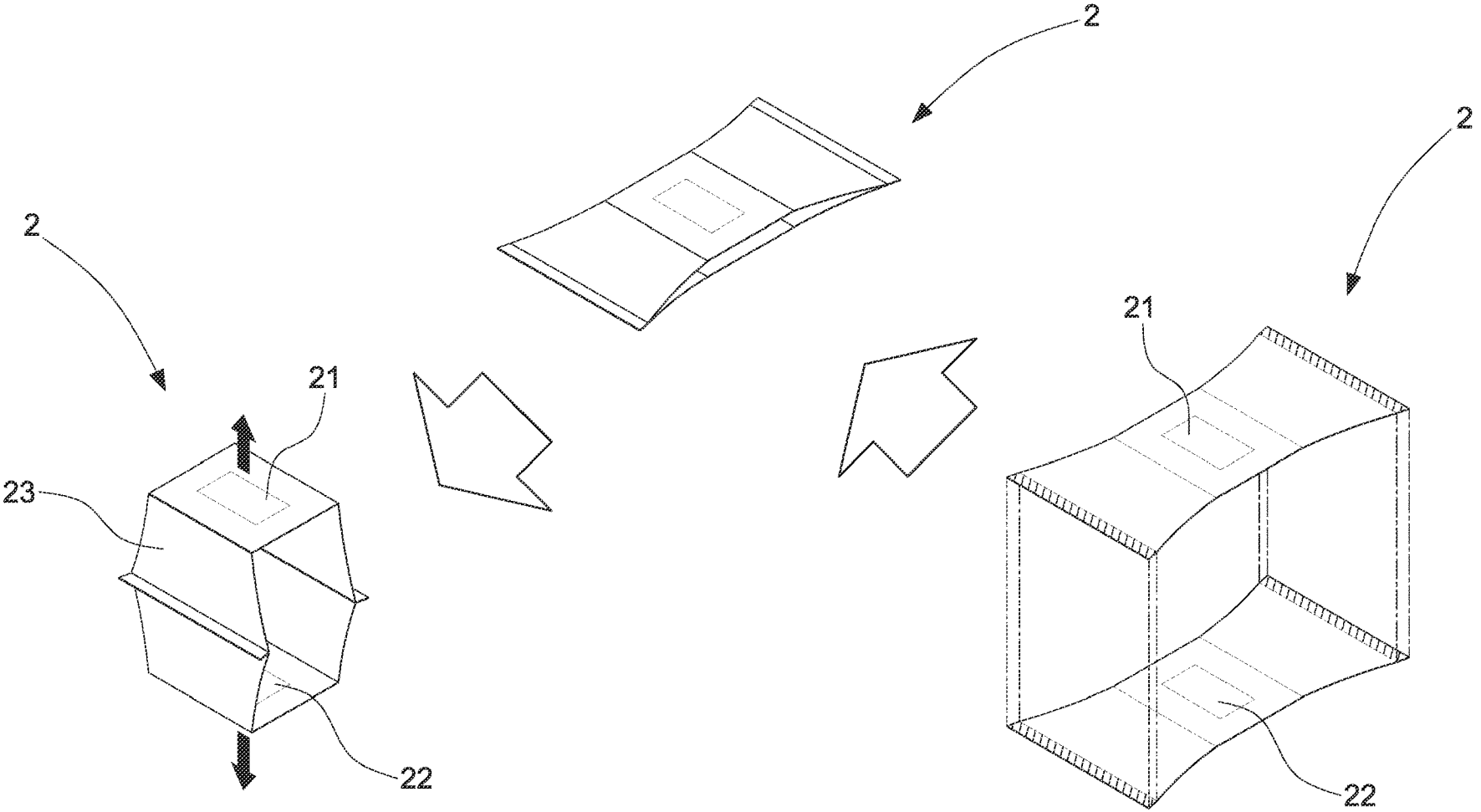
FIG. 4 is a schematic view of the connecting member according to a second embodiment of the present invention.
Figure 5:
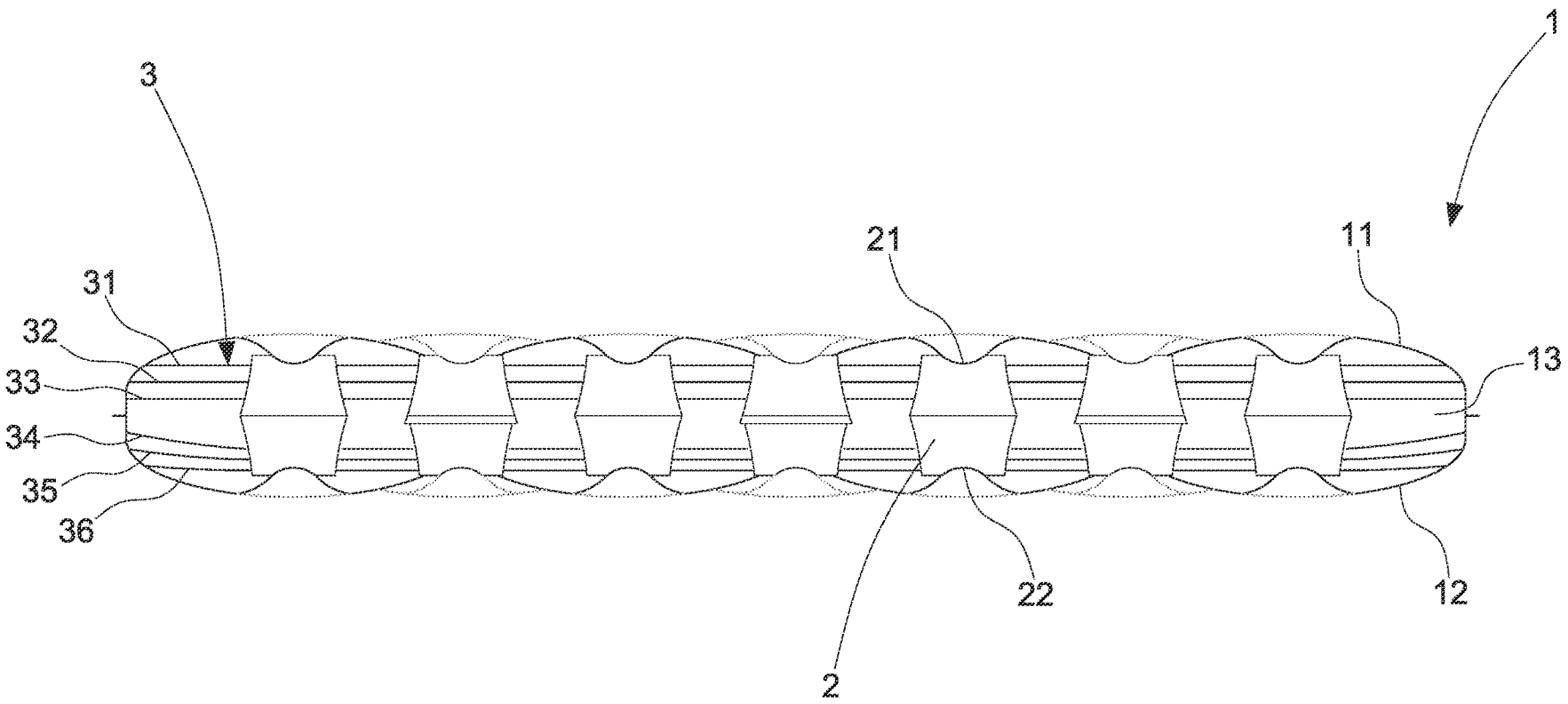
FIG. 5 is a cross-sectional view according to the second embodiment of the present invention.

FIG. 4 and FIG. 5 illustrate a second embodiment of the present invention. The side piece 23 of the connecting member 2 is changed from the trapezoid shape having a narrow upper portion and a wide lower portion to a regular hexagon shape having narrow upper and lower portions and a wide middle portion.

In addition, the side piece 23 may have various modifications and enhancements. All the features of utilizing different heights of the connecting member 2 to match the openings with different widths for locking and positioning the blocking unit 3 are all within the scope of the present invention.

What is claimed is:

1. A portable mat comprising:

a first outer covering layer, a second outer covering layer, peripheries of the first outer covering layer and the second outer covering layer being joined and closed;

a plurality of connecting members, the connecting members being connected between the first outer covering layer and the second outer covering layer, the connecting members each having different widths according to high and low positions;

a blocking unit, the blocking unit including a plurality of blocking layers being located within an interior of the joined first and second outer covering layers, the blocking layers each having an opening corresponding in position to the connecting member so that the blocking layers are spaced apart from each other to form a plurality of spaced spaces not in communication with each other, wherein each connecting member penetrates through and out of openings of the plurality of blocking layers, and air convection and temperature radiation in one spaced space are not communicated with the air convection and the temperature radiation in the other spaced space.

2. The portable mat as claimed in claim 1, wherein the connecting member is in the form of a thin and light ring.

3. The portable mat as claimed in claim 1, wherein the connecting member consists of two sheets joined together, or the connecting member is a single-sheet integrated structure.

4. The portable mat as claimed in claim 1, wherein a first joining portion is disposed on a top of the connecting member, the first joining portion is joined to an inner edge of the first covering layer, a second joining portion is disposed on a bottom of the connecting member, and the second joining portion is joined to an inner edge of the second covering layer.

5. The portable mat as claimed in claim 1, wherein the connecting member includes two corresponding side pieces.

6. The portable mat as claimed in claim 5, wherein the side pieces each have different widths according to the high and low positions, and have a trapezoid shape with a narrow upper portion and a wide lower portion.

7. The portable mat as claimed in claim 5, wherein the side pieces each have different widths according to the high and low positions, and have a regular hexagon shape with narrow upper and lower portions and a wide middle portion.

8. The portable mat as claimed in claim 1, wherein the openings of the blocking layers are different in size corresponding to the different widths of the high and low positions of the connecting member.

9. The portable mat as claimed in claim 1, wherein the openings of the blocking layers are different in size corresponding to the different widths of the connecting member, so that the blocking layers are positioned at different heights.

10. The portable mat as claimed in claim 1, wherein the blocking unit is made of a polyester film material with high reflectivity and low absorptivity.

* * * * *